US005245354A

United States Patent [19]

Ono et al.

[11] Patent Number: 5,245,354

[45] Date of Patent: Sep. 14, 1993

[54] THERMAL TRANSFER RECORDING APPARATUS AND METHOD WITH IMPROVED INK SHEET TRANSPORT

[75] Inventors: Takeshi Ono, Kawasaki; Takehiro Yoshida, Tokyo; Makoto Kobayashi, Tama; Masaya Kondo, Tokyo; Tomoyuki Takeda, Yakohama; Minoru Yokoyama, Yokohama; Yasushi Ishida, Tokyo; Akihiro Tomoda, Yokohama; Takashi Awai, Tokyo; Masakatsu Yamada, Yokohama, all of Japan

[73] Assignee: Canon Kabushiki Kaisha, Tokyo, Japan

[21] Appl. No.: 810,124

[22] Filed: Dec. 19, 1991

[30] Foreign Application Priority Data

Dec. 26, 1990 [JP] Japan ..... 2-406812
Dec. 13, 1991 [JP] Japan ..... 3-330178

[51] Int. Cl.[5] ..... B41J 2/325

[52] U.S. Cl. ..... 346/1.1; 346/76 PH; 358/296; 400/120; 400/224.1

[58] Field of Search ..... 346/1.1, 76 PH; 400/224.1, 224.2, 225, 236, 236.1, 236.2, 232, 120; 358/296

[56] References Cited

U.S. PATENT DOCUMENTS 3,984,809 10/1976 Dertouzous et al. ..... 346/76 R
4,910,602 3/1990 Sakuragi ..... 346/76 PH
4,973,985 11/1990 Genno et al. ..... 400/236.2

FOREIGN PATENT DOCUMENTS 57-83471 5/1982 Japan .
58-7377 1/1983 Japan .
58-201686 11/1983 Japan .
0120078 6/1985 Japan ..... 400/236
0262681 12/1985 Japan ..... 400/236.2

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A thermal transfer recording apparatus which performs image recording by causing a recording head to act on an ink sheet so as to transfer ink from the ink sheet onto recording paper. Changes in the take-up amount of the ink sheet, which is fed by being wound onto a take-up roller, are detected from changes in the amount by which the ink sheet is fed with respect to a given drive amount of an ink-sheet feeding motor, and, on the basis of the changes detected, the driving torque for the ink-sheet feeding motor is changed, thereby reducing the noise generated and the power consumed by the apparatus.

9 Claims, 10 Drawing Sheets

THERMAL TRANSFER RECORDING APPARATUS AND METHOD WITH IMPROVED INK SHEET TRANSPORT

BACKGROUND OF THE INVENTION

1. Field of the Invention

This invention relates to a thermal transfer recording apparatus which records using ink sheets, and to a facsimile apparatus equipped with such a recording apparatus and to a method thereof.

Apart from a facsimile apparatus, the thermal transfer recording apparatus of this invention is applicable to office equipment such as an electronic typewriter, word processor, copying machine, and computer, and further, to communication equipment.

2. Description of the Related Art

There are various different types of thermal transfer printers including the type of printer using so-called one-time ink sheets, with which the ink is completely transferred from the ink sheet onto the recording paper at one printing, and a printer using so-called multi-time ink sheets that allow recording to be effected a plurality of times (N times) at any given position on the sheet, with the recording paper and the ink sheet being fed at different speeds. Thermal transfer printers of the latter type have higher operating costs as compared with the former; in view of this, nowadays, such printers are generally used as the recording unit in a facsimile apparatus or the like. Further, U.S. Pat. No. 4,910,602 shows a thermal transfer printer in which an ink sheet is contained in a case which can be detachably attached to the recording apparatus body, the ink sheet being loaded and unloaded along with this case. With this type of thermal transfer printer, the multi-time ink sheet is so constructed that it is taken up by driving a take-up roller by means of an ink-sheet take-up motor. The take-up torque for driving this take-up roller is set to a constant value for all the take-up stages of an ink sheet, as in conventional thermal transfer printers. Thus, even in a stage where most of the ink sheet has been wound onto the take-up roller, that is, even when the ink sheet is near its end, the same torque is applied to drive the take-up roll as is used in initial stages.

A problem with this type of ink-sheet take-up operation is that in the initial stages of use of the ink sheet, the ink sheet advances too far in the feeding direction, and so it has to be rewound a bit after each feed; as a result of repeating this useless movement, a noise is generated, or an extra load is applied to the ink sheet.

After assiduous study of this behavior, the present inventors found that the above problem was due to the fact that the same torque was used to drive the take-up roller in both the initial and final take-up stages. This may be explained as follows: In the initial stages of use, the ink-sheet supply roller has a relatively large diameter, whereas the diameter of the take-up roller is relatively small, which means the driving torque required to rotate the take-up roller is relatively small. In the later stages of use of the ink sheet, in contrast, the take-up roller has a relatively large diameter, and its weight is also larger than in the initial stages; as a result, rotation of the take-up roller requires a larger driving force, which means the take-up torque supplied by the take-up motor must be increased as the ink sheet approaches the final stages of its use. This difference in requisite torque between the initial and final stages of use, attributable to the change in the diameter of the take-up roller, is quite large due to the fact that a back tension in the direction of the supply roller is being applied to the ink sheet in order to eliminate any sag thereof. Furthermore, it should also be remembered that the thermal head is being pressed against the platen roller with a large force. Thus, if, as in the above example, the torque applied to the take-up roller is kept constant, an excessively large torque must be applied to the take-up roller in the initial stages of use of the ink sheet, and this will cause, for example, an overshoot of the rotating shaft of the take-up motor, making the ink-sheet move unnecessarily, thereby generating a noise, applying an extra load on the ink sheet, or giving rise to a loss in energy (wasteful power consumption) of the take-up motor.

SUMMARY OF THE INVENTION

This invention has been made to overcome the above problem in the prior art and is based on a concept which has not been recognized up till now.

This invention aims to solve the above-mentioned problem in the prior art; it is accordingly an object of this invention to provide a thermal transfer recording apparatus in which the driving torque for the ink-sheet feeding means is made variable so that the ink sheet can always be taken up with an appropriate torque, thereby reducing noise, saving energy, and mitigating the load on the ink sheet, as well as a facsimile apparatus equipped with such a thermal transfer recording apparatus.

In accordance with one aspect of the present invention, a thermal transfer recording apparatus performs image recording by transferring ink from an ink sheet onto a recording medium. This recording apparatus has ink sheet feeding means which feeds the ink sheet by taking up the ink sheet. Recording medium feeding means feeds the recording medium and recording means records on the recording medium. Detection means is used to detect a detection result that corresponds to changes in an amount by which the ink sheet is taken up. Control means is used to control a driving torque of the ink sheet feeding means in accordance with the detection result obtained by the detection means.

In accordance with another aspect of the present invention, a facsimile apparatus performs image recording by transferring ink from an ink sheet onto a recording medium. This device has ink sheet feeding means for feeding the ink sheet by taking up the ink sheet. Recording medium feeding means feeds the recording medium, and image signal receiving means receives an image signal. Recording means for recording acts on the ink sheet according to the image signal received by the image signal receiving means to record on the recording medium, and detection means detects a detection result corresponding to changes in the amount of ink sheet taken up by the ink sheet feeding means. Finally, control means controls and changes the driving torque of the ink sheet feeding means in accordance with the detection result detected by the detection means.

In accordance with yet another aspect of the present invention, a thermal transfer recording apparatus performs image recording by transferring ink from an ink sheet onto a recording medium. The apparatus has ink sheet feeding means for feeding the ink sheet by taking up the ink sheet, recording medium feeding means for feeding the recording medium, recording means for recording which acts on the ink sheet, and detection means for detecting an amount by which the ink sheet is fed with respect to a given drive amount of the ink sheet feeding means. In addition, drive control means controls the ink sheet feeding means and recording medium feeding means so that the ink sheet is fed by an amount which is smaller than the amount by which the recording medium is fed, and which further controls the ink sheet feeding means by changing the torque in accordance with the detection result obtained by the detection means.

In accordance with still yet another aspect of the invention, a method of thermal transfer recording is taught involving providing feeding means for feeding an ink sheet, the feeding means having a driving torque and taking up the ink sheet by an amount, and providing recording medium feeding means for feeding a recording medium. Recording is performed on the recording medium by acting on the ink sheet to transfer ink on the ink sheet to the recording sheet. A detection result corresponding to a change in the amount of the ink sheet taken up is detected, and the driving torque is changed in accordance with this detection result.

DETAILED DESCRIPTION OF THE PREFERRED EMBODIMENTS

Preferred embodiments of this invention will now be described in detail with reference to the accompanying drawings.

FIGS. 1 to 11 are drawings showing a thermal transfer recording apparatus designed in accordance with an embodiment of this invention as applied to a facsimile apparatus.

Figure 1:
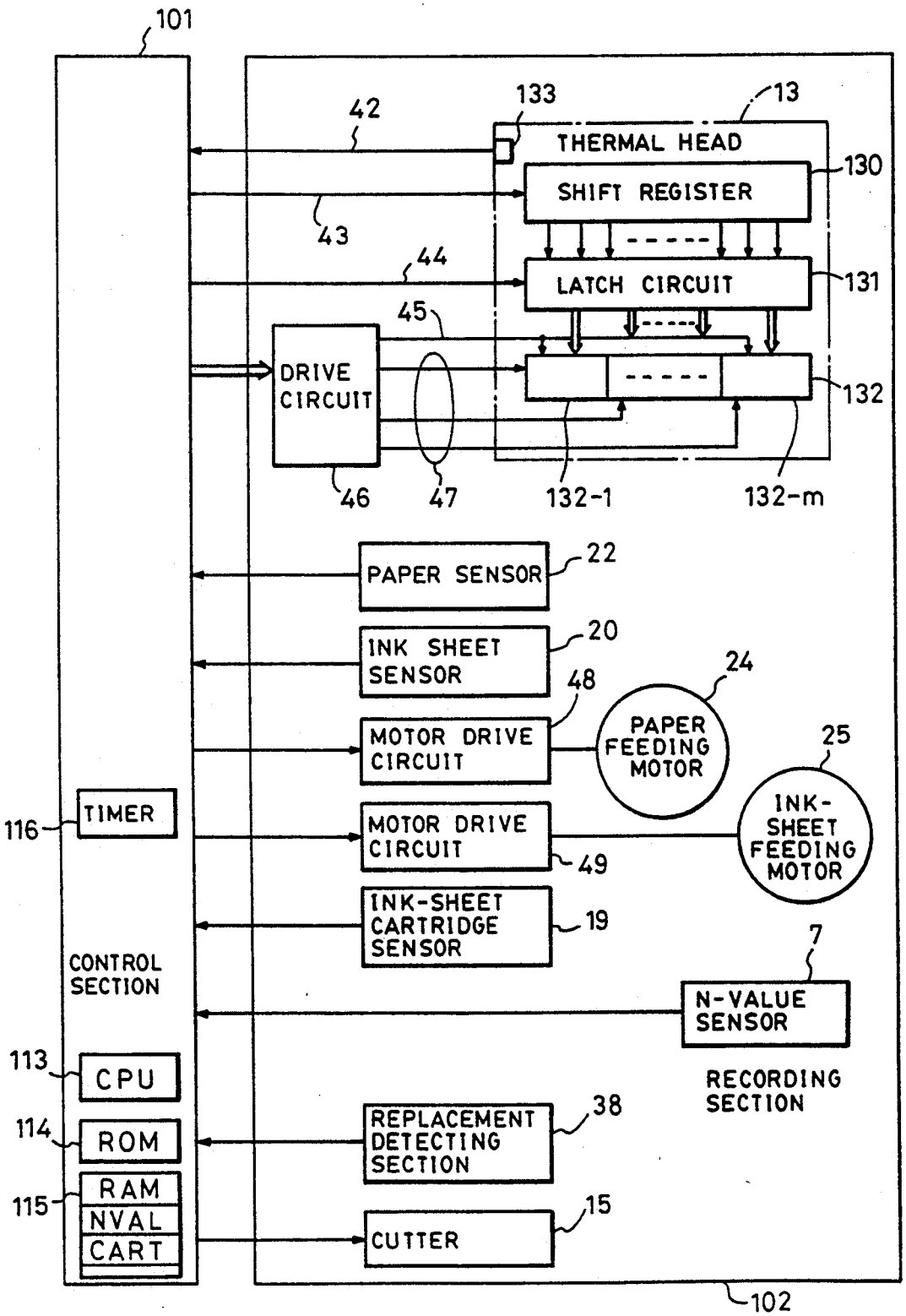
FIG. 1 is a diagram showing the electrical connections in a control section and recording section of a facsimile apparatus designed in accordance with an embodiment of this invention.

FIG. 1 is a diagram showing the electrical connections in a control section 101 and a recording section 102 of the facsimile apparatus containing this embodiment. In the drawing, those components common to the other drawings are referred to by the same reference numerals.

Recording section 102 has a thermal head 13, which is a line-head type. Thermal head 13 includes a shift register 130, which receives serial recording data 43 of one-line information supplied from the control section 101 in synchronism with a shift clock, and retains the data, a latch circuit 131, which latches the data of the shift register 130 by means of a latch signal 44, and a heat generating device 132, which consists of a group of heat generating resistors for printing one-line information. The heat generating resistors are divided into m blocks, which are referred to as the blocks 132-1 to 132-*m*; these blocks are driven separately. The different parts of the control section 101 are controlled by a CPU 113, which consists of a microprocessor, etc.

Reference numeral 133 indicates a temperature sensor, which is attached to the thermal head 13 and serves to detect the temperature thereof. The output signal of this temperature sensor 133, indicated at 42, is A/D-converted in the control section 101 and supplied to the CPU 113, whereby the CPU 113 detects the temperature of the thermal head 13 and, in accordance with this temperature, changes the pulse width of a strobe signal 47 or the driving voltage for the thermal head 13. In this way, the amount of energy applied to the thermal head 13 is changed in accordance with the characteristics of the ink sheet, which is indicated at 14.

The characteristics (the type) of the ink sheet 14 used are designated by an operating section 103. It is also possible for the type or characteristics of the ink sheet 14 to be identified by a mark or the like printed on the sheet itself. Alternatively, the ink-sheet type may be identified by a mark, cutout, projection or the like provided on the ink-sheet cartridge, etc.

Reference numeral 116 indicates a programmable timer, which is set by the CPU 113; it starts time measurement upon receiving an instruction to that effect, and emits, at each designated time, an interrupt signal, a time-out signal, etc. to the CPU 113. By means of this timer 116, the length of time the thermal head 13 is energized can be measured. Reference numeral 46 indicates a drive circuit, which receives a drive signal from the control section 101, and drives the thermal head 13 block by block (recording means). Further, this drive circuit 46 is capable, if so instructed by the control section 101, of changing the voltage supplied to a power line 45 for supplying electric current to the heat generating device (the resistors) 132 of the thermal head 13, thereby changing the amount of energy applied to the thermal head 13. Reference numerals 48 and 49 respectively indicate a driving circuit for a recording-paper feeding motor 24 (part of the recording medium feeding means) and a driving circuit for an ink-sheet feeding motor 25 (part of the ink sheet feeding means). In this embodiment, the recording-paper feeding motor 24 and the ink-sheet feeding motor 25 are stepping motors. This, however, is not restrictive, and they may also be, for example, DC motors. Reference numeral 38 indicates an ink-sheet-replacement detecting section, which serves to detect any replacement of the ink sheet 14 by a new one and which is operationally connected with a lever or the like for loading/unloading the apparatus with ink sheets. The detecting section 38 emits a pulse signal when the ink sheet 14 is replaced by a new one, thereby informing the control section 101 of the replacement. Apart from the CPU 113, the control section 101 is further equipped, for example, with a ROM 114, which stores a control program for the CPU 113, various items of data, etc., and a RAM 115 which serves as a work area for the CPU 113 by temporarily retaining various items of data.

Figure 2:
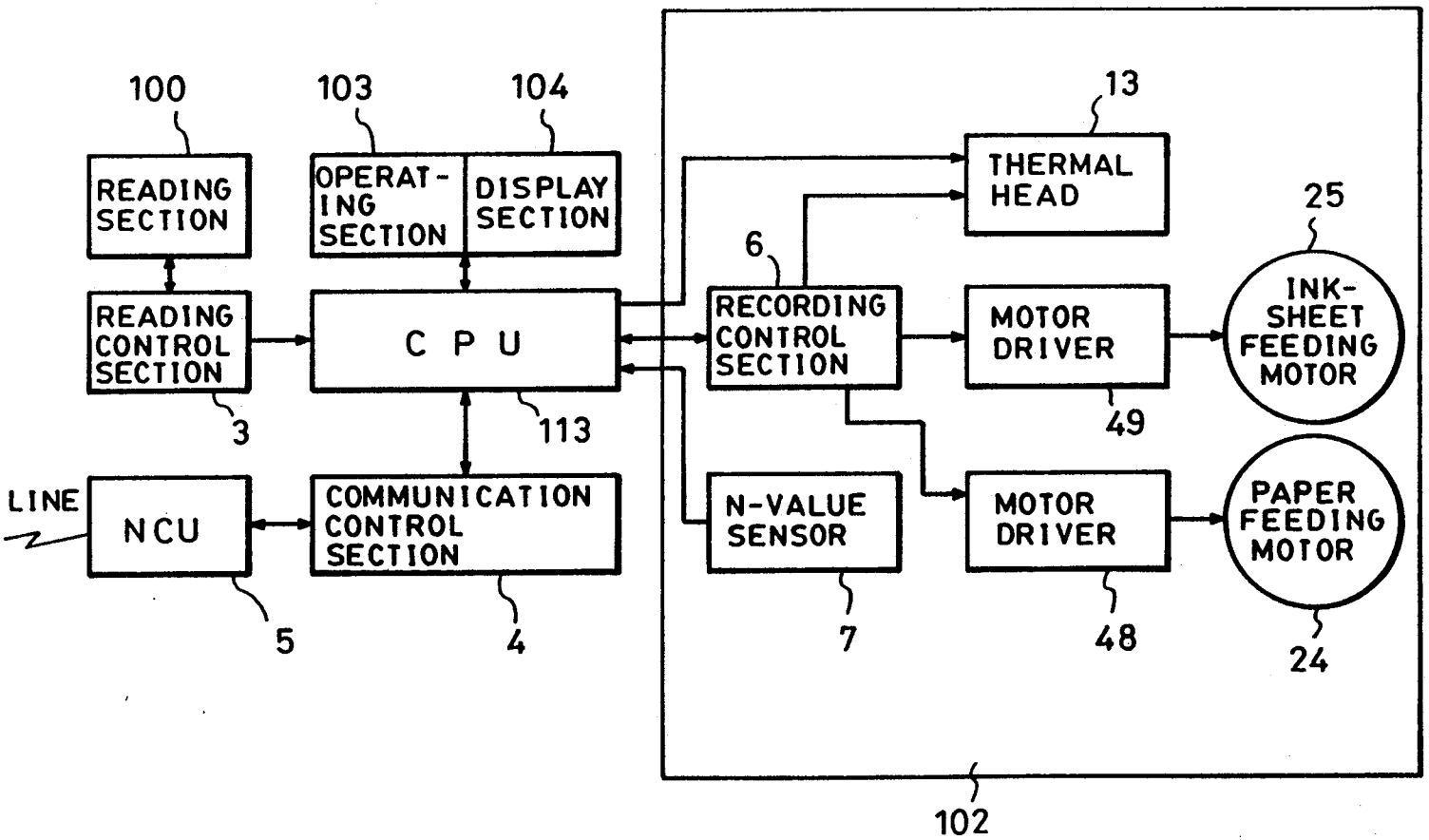
FIG. 2 is a block diagram schematically showing the construction of the facsimile apparatus of this embodiment.

FIG. 2 is a block diagram schematically showing the general construction of the facsimile device of this embodiment.

In the drawing, reference numeral 113 indicates the CPU for controlling the entire apparatus; reference numeral 103 indicates an operating section operated by the operator and having keys for designating various functions such as transmission start and for entering telephone numbers, etc. Reference numeral 104 indicates a display section composed of liquid crystals, LED's or the like and which serves to display various messages, etc. for the operator. Reference numeral 100 indicates a reading section, which reads originals photoelectrically and outputs them in the form of digital image signals. This reading section 100 is equipped with an original feeding motor, a CCD image sensor, etc. Reference numeral 3 indicates a reading control section for controlling the reading section 100, and reference numeral 4 indicates a communication control section for controlling the transmitting and receiving operations through an NCU 5.

Reference numeral 6 indicates a recording control section for controlling the entire recording section 102, which performs image recording on recording paper by the thermal transfer recording method. The construction of this recording section 102 will be described in detail below with reference to FIG. 3. Reference numeral 7 indicates an N-value sensor, part of a detection means, which detects the amount by which the recording paper is fed (the recording-paper feed amount) with respect to a given amount by which the ink-sheet portion is fed (an ink-sheet feed amount), and calculates the ratio of one to the other, (N); this ratio can be expressed as the distance that the recording paper 11 is fed divided by the distance that the ink sheet 14 is fed. Reference numerals 48 and 49 indicate motor drive circuits, which respectively drive the recording-paper feeding motor 24 and the ink-sheet feeding motor 25 in accordance with instructions from the CPU 113. Reference numeral 13 indicates the line-type thermal head, which is equipped with a heat generating device for one-line information and which is adapted to perform line by line recording.

Next, the construction of the recording section 102 will be described in detail with reference to FIG. 3, which is a side sectional view of the facsimile apparatus of this embodiment. In the drawing, those components which are common to FIGS. 1 and 2 are referred to by the same reference numerals.

Figure 3:
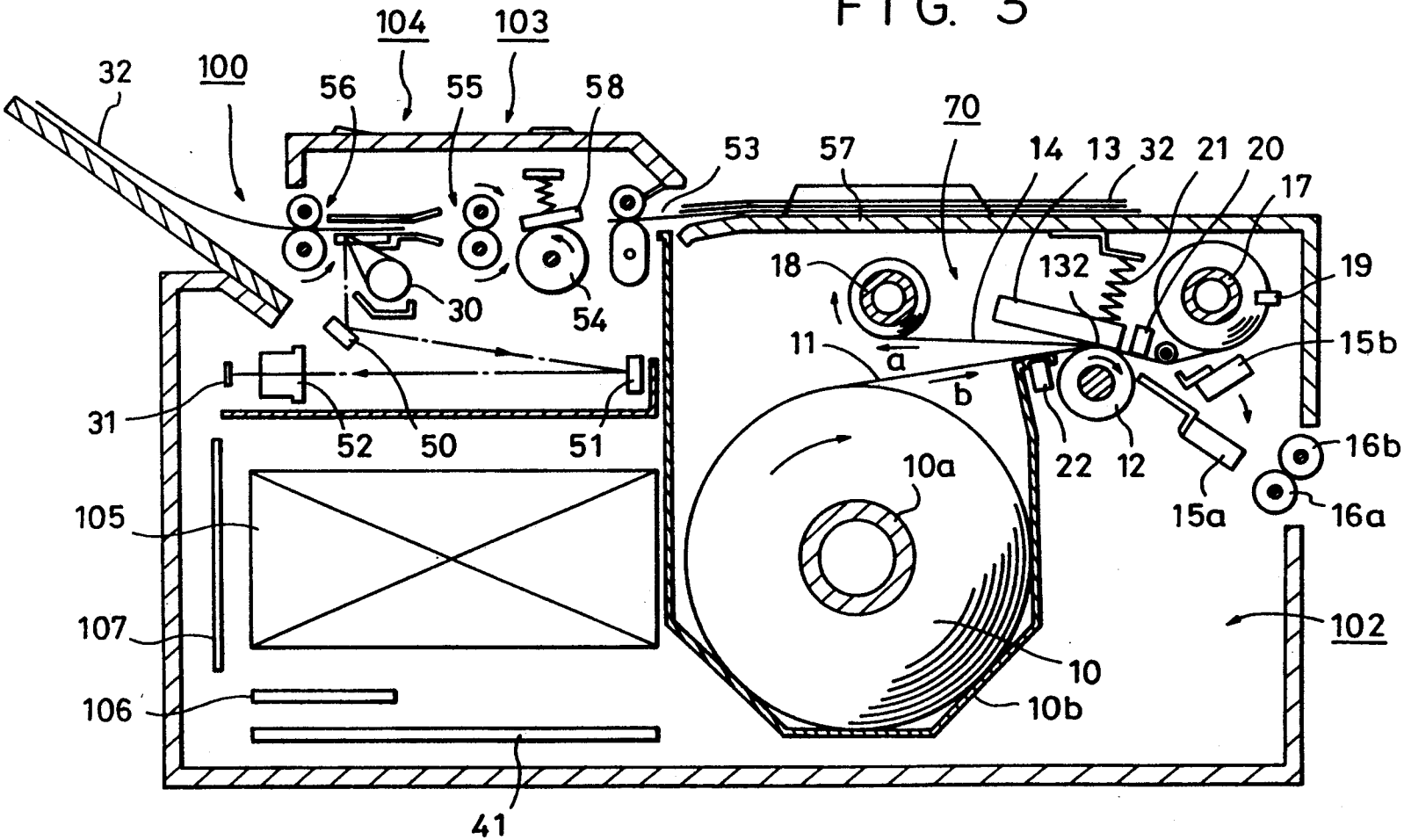
FIG. 3 is a side sectional view of this facsimile apparatus.

In FIG. 3, Reference numeral 10 indicates a roll of paper, which consists of an ordinary recording paper 11 wound around a core 10*a* to form a roll. This roll of paper 10 is rotatably mounted in the apparatus so that the recording paper 11 may be conveyed past the thermal head 13 when a platen roller 12 rotates in the direction of the arrow. Reference numeral 10*b* indicates a paper lodging section, which allows the roll of paper 10 to be detachably placed in the apparatus. The platen roller 12 is part of the recording medium feeding means and, as mentioned above, shifts the recording paper 11 in the direction of the arrow b and, at the same time causes the ink sheet 14 and the recording paper 11 to be pressed against the heat generating device 132 of the thermal head 13. When image recording has been performed on recording paper 11 by the heat generated in the thermal head 13, the recording paper 11 is fed by a further rotation of the platen roller 12 in the direction of discharge rollers 16*a* and 16*b*; when image recording of one page has been completed, that portion of the paper 11 corresponding to that page is cut off by cutter blades 15*a* and 15*b*.

Reference numeral 17 indicates an ink-sheet supply roll, and Reference numeral 18 indicates an ink-sheet take-up roller which is driven by the ink-sheet feeding motor 25 and which takes up the ink-sheet 14 in the direction indicated by the arrow a (ink sheet feeding means). The ink-sheet supply roll 17 and the ink-sheet take-up roller 18 are detachably arranged in an ink-sheet lodging section 70 of the apparatus body. Further, reference numeral 19 indicates a sensor for checking whether or not the apparatus is loaded with an ink-sheet cartridge. Reference numeral 20 indicates an ink-sheet sensor which checks whether there is any ink-sheet 14 or not and which optically determines the remaining amount of the ink sheet 14 on the basis of a mark provided on the ink sheet. Reference numeral 21 indicates a spring which presses the thermal head 13 against the platen roller 12, with the recording paper 11 and the ink sheet 14 passing therebetween, and reference numeral 22 indicates a recording-paper sensor for checking if there is any recording paper.

Next, the construction of the reading section 100 will be described.

In FIG. 3, reference numeral 30 indicates a light source for illuminating originals 32. The light reflected by each original 32 is transmitted through an optical system (which consists of mirrors 50 and 51 and a lens 52) to a CCD sensor 31, where it is converted to an electrical signal. The originals 32 are conveyed by feeding rollers 53, 54, 55 and 56, which are driven by an original feeding motor (not shown) at a speed corresponding to the speed at which they are read. Reference numeral 57 indicates an original tray; the originals 32, which are stacked on this original tray 57, are separated from each other by the co-operation of the feeding roller 54 and a press-separation member 58, and are fed one by one to the reading section 100.

Reference numeral 41 indicates a control board, which constitutes the principal section of the control section including the CPU 113. Various control signals are output from this control board to each section of the apparatus. Reference numeral 106 indicates a modem board unit, which includes the above-mentioned communication control section 4 (image signal receiving means). Reference numeral 107 indicates a board unit for the NCU 5.

Figure 4:
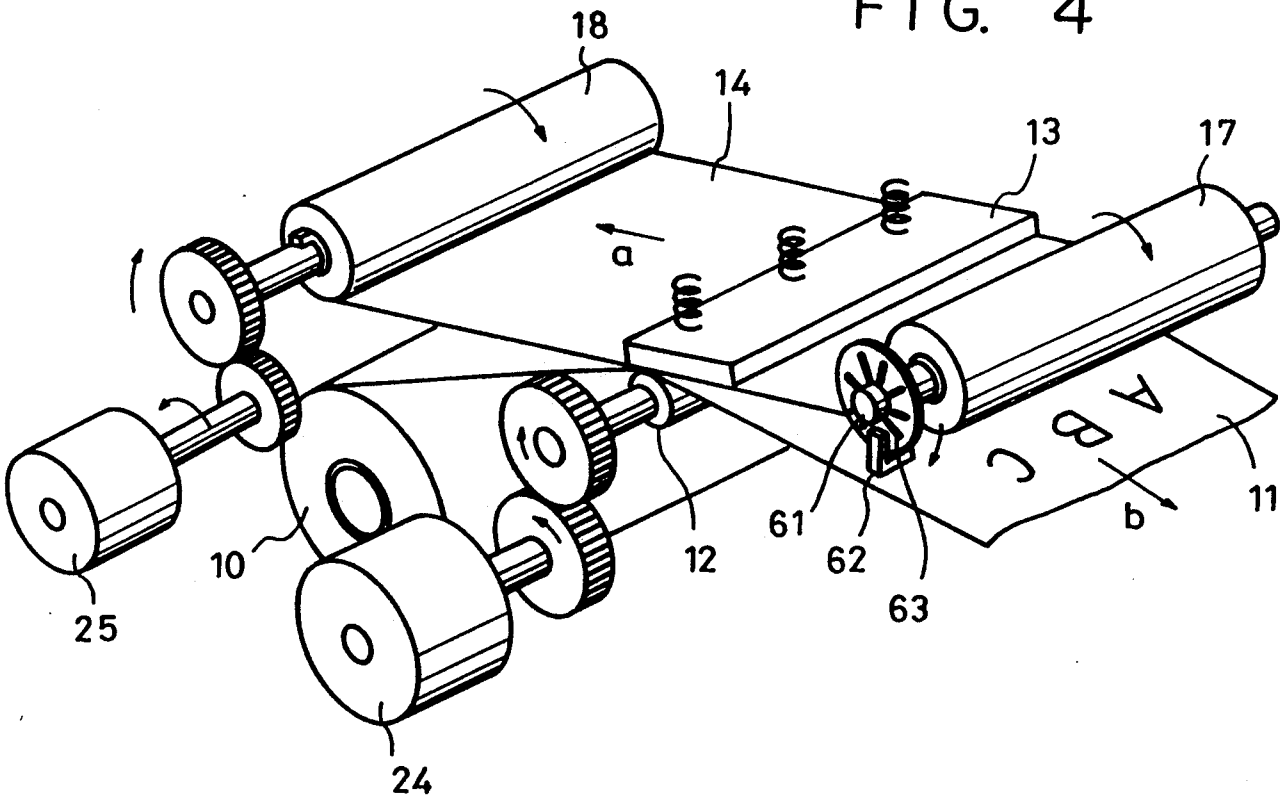
FIG. 4 is an external perspective view of the mechanism of the recording section of the facsimile apparatus.

FIG. 4 is an external perspective view showing the mechanism of this recording section 102.

As stated above, the recording paper 11, supplied from the roll of paper 10, is fed in the direction of the arrow b when the platen roller 12 is rotated by the recording-paper feeding motor 24, by virtue of the frictional force caused by the pressure applied by the thermal head 13. The ink sheet 14 is wound around a core to form the supply roll 17, and is fed in the direction of the arrow a to be wound up by the take-up roller 18 when the ink-sheet feeding motor 25 is driven. The components indicated by reference numerals 61, 62 and 63 constitute an example of the N-value sensor 7 (detection means); in this example, slits 63 are formed at equal intervals on a disc 61 which is attached to the rotating shaft of the ink-sheet supply roll 17, and a photo-interrupter 62 photoelectrically detects the passing of the slits 63.

Since the recording paper 11 is fed by the platen roller 12 which is rotated by the recording-paper feeding motor 24, the amount by which the recording paper 11 is fed with respect to a given amount of rotation of the recording-paper feeding motor 24 is always constant. In contrast, the ink sheet 14 is fed by rotating the take-up roller 18 by means of the ink-sheet feeding motor 25. Thus, the amount by which the ink sheet 14 is fed depends on the revolving speed of the take-up roller 18, which is driven by the ink-sheet feeding motor 25. Because of this, the amount by which the ink sheet 14 is fed with respect to a given amount of rotation of the ink-sheet feeding motor 25 is not constant, but changes as the amount of the ink sheet 14 wound around the ink-sheet take-up roller 18 (i.e., the diameter of the take-up roller 18) increases.

In this construction, as the diameter of the ink-sheet take-up roller 18 increases, the amount of rotation of the disc 61 (the amount of rotation of the supply roller 17) per drive step of the ink-sheet feeding motor 25 also increases. Since the slits 63 are arranged at equal intervals on the disc 61, the ON/OFF interval of the photo-interrupter with respect to a given amount of rotation of the ink-sheet feeding motor 25 becomes shorter. Thus, it will be understood that as the diameter of the ink-sheet take-up roller 18 becomes larger, the greater becomes the distance the ink-sheet 14 is fed with respect to a given amount of rotation of the ink-sheet take-up motor 25. That is, when the ink-sheet feeding motor 25 is driven at a fixed rate, as more of the ink sheet 14 is used, the larger become the winding diameter of the ink-sheet take-up roller 18 and accordingly so does the distance by which the ink-sheet 14 is fed per unit time with respect to the distance by which the recording paper 11 fed per unit time. The N-value, which indicates the number of multi-printings performed and which corresponds to the length of recording paper fed divided by the length of ink sheet feed, therefore becomes smaller. Accordingly, when a signal from the N-value sensor 7, which is composed of disc 61, slits 63 and photo-interrupter 62, shows that the N-value has dropped below a certain value, the feed amount of the ink-sheet 14 corresponding to one-line recording is reduced to increase the N-value by control means that changes the driving torque of the ink sheet feeding means.

Further, since in the initial stages of use of the ink sheet 14 the diameter of the take-up roller 18 is relatively small and the requisite torque for taking up the ink sheet may be accordingly small, the driving torque for the motor 25 is made relatively small, thereby avoiding an overshoot of the rotating shaft of the motor 25, reducing noise, and preventing an extra load from being applied to the ink sheet. In addition, wasteful power consumption by the motor 25 can be reduced. As more of the ink sheet is used, the diameter of the take-up roller 18 increases and so the torque needed to take up the ink sheet has to be increased. In view of this, the driving torque for the motor 25 is raised, thereby stabilizing the feeding of the ink sheet. In this embodiment, the driving torque of the motor 25 is changed once the N-value has become smaller than a certain value, as in the changing of the feed amount of the ink sheet 14.

Figure 5:
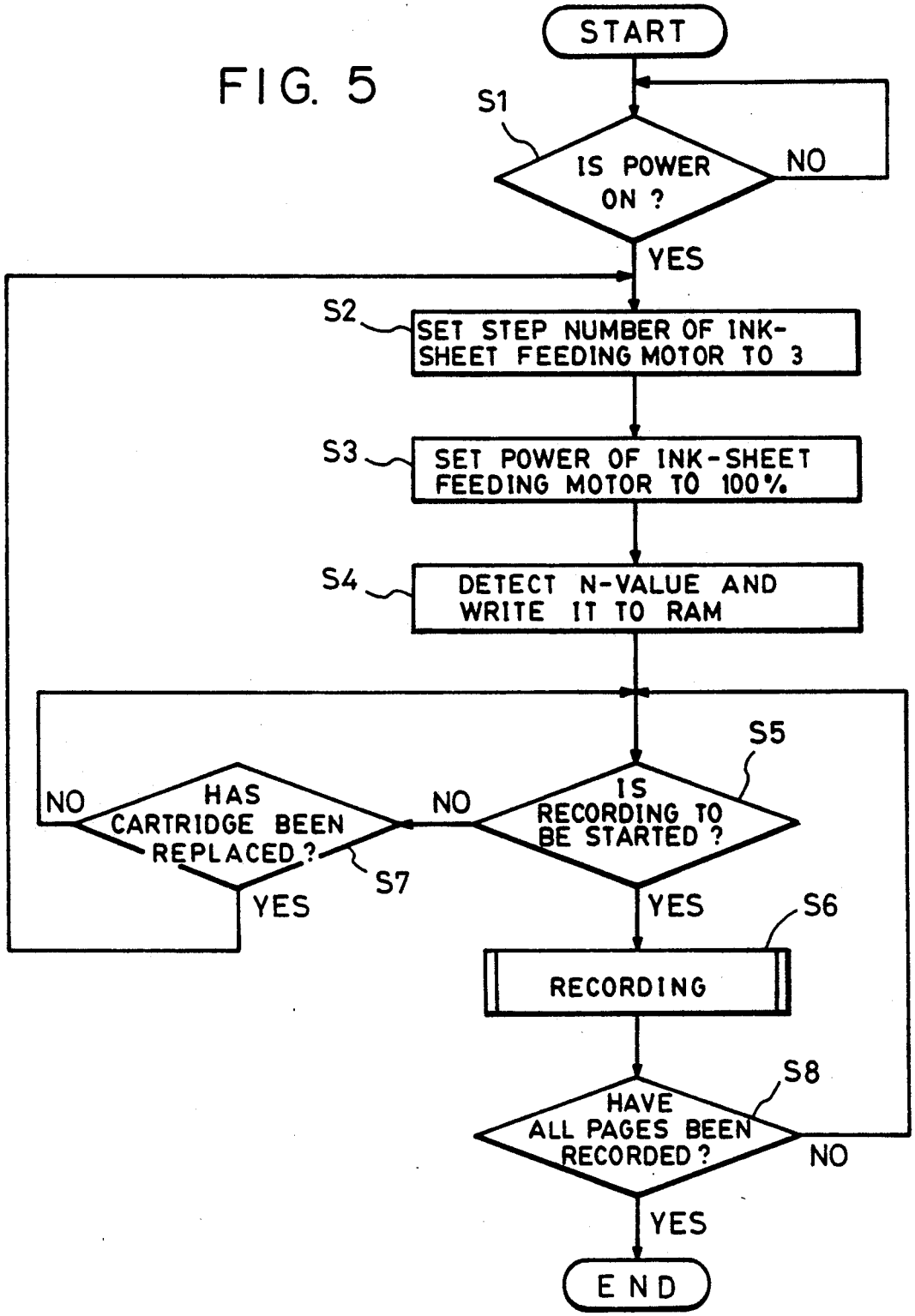
FIGS. 5 and 6 are flowcharts illustrating operations executed by a CPU provided in the facsimile apparatus.
Figure 6:
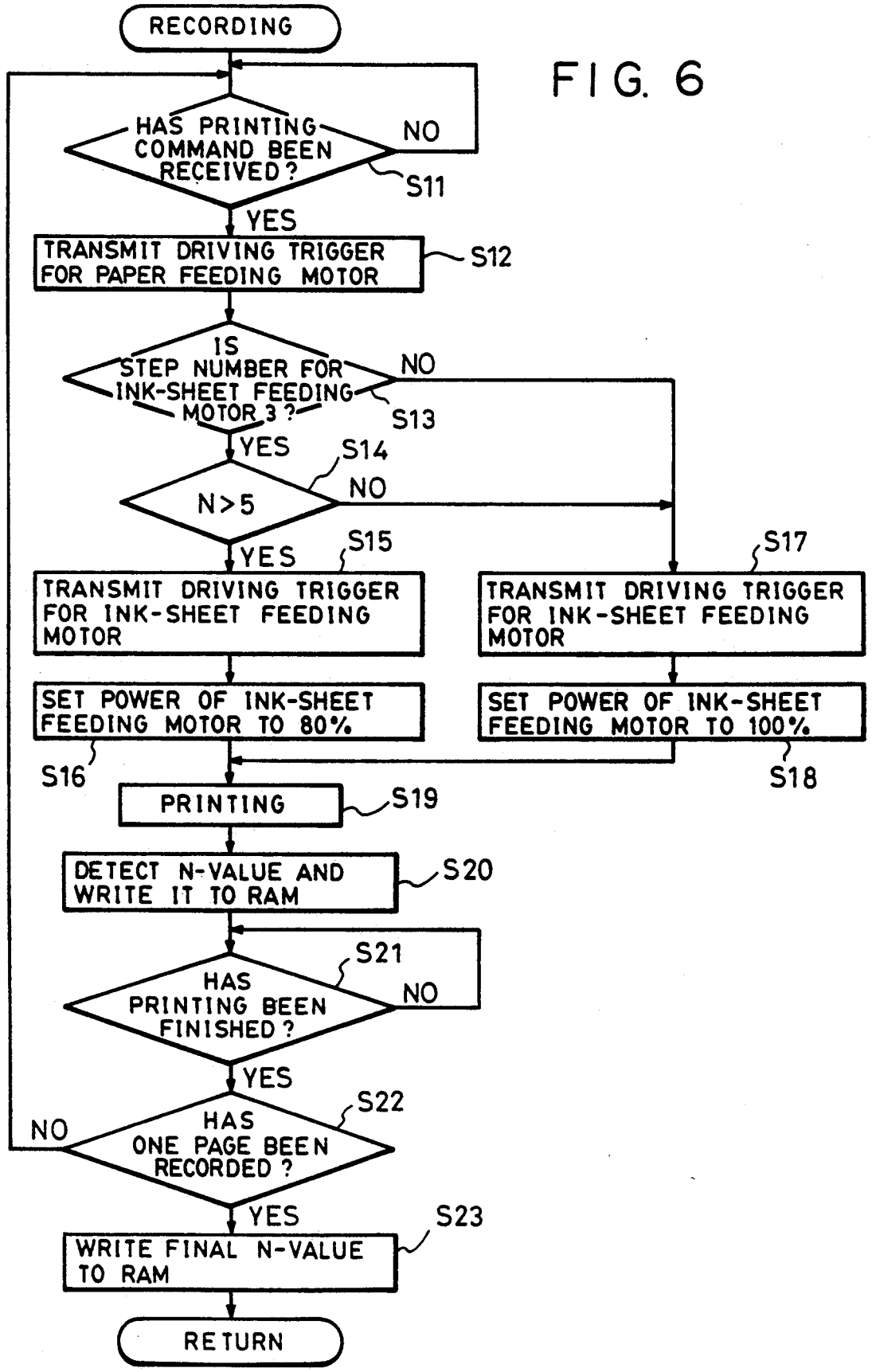

FIGS. 5 and 6 are flowcharts showing the recording operation executed by the CPU 113 (control means) of the facsimile apparatus of this embodiment.

First, in step S1, the power is turned ON, and the procedure advances to step S2, where the CPU 113 sets the number of driving steps for the ink-sheet feeding motor 25 to 3. Then, the procedure advances to step S3, where the driving torque for the ink-sheet feeding motor 25 is set to 100%. More specifically, the value of the driving current for the motor 25 is set to the maximum value, 100% of the current (e.g., 500 mA).

Next, the procedure advances to step S4, where the N-value is detected on the basis of a signal from the N-value sensor 7. As described above, the N-value sensor 7 is composed of disc 61, slits 63 and photo-interrupter 62; when the ink-sheet feeding motor is driven a predetermined amount, an N-value sensor counter counts the number of times a detection signal (a slit signal), which indicates the detection of a slit 63 by the photo-interrupter 62, is changed from ON to OFF or from OFF to ON. Further, the number of lines recorded during this time is counted by a line counter; the line number thus counted is divided by the count number of the N-value counter, thereby obtaining the average number of lines when the slit signal of the N-value sensor 7 is changed from ON to OFF, or from OFF to ON.

As the recording operation proceeds, the winding diameter of the ink-sheet take-up roll 18 increases and so the feed distance of the ink sheet 14 per unit time likewise increases with respect to the feed distance of the recording paper 11 per unit time. The N-value, which indicates the number of multi-printings, therefore becomes smaller. In this process, the number of lines printed when the slit signal changes from ON to OFF, or OFF to ON, also decreases. Thus, by determining this change in line number, the change in N-value can be ascertained without having to directly obtain the N-value. In accordance with this embodiment, the average line number is obtained in step S4, as an indicator of the N-value, as stated above, and is written to an initial N-value storage area of the RAM 115.

Next, in step S5, the CPU 113 makes a judgment as to whether the recording operation is to be started or not; when the reception of the facsimile data of a next page is detected by the CPU 113, it is determined that recording is to be started. When the recording operation is not started, the procedure advances to step S7, where it is checked whether the ink cartridge has been replaced by a new one. This check is effected on the basis of a signal from the ink-sheet cartridge sensor 19 such as a microswitch, which is received by the CPU 113. When it is determined in step S7 that the ink-sheet cartridge has been replaced, it can be assumed that the winding diameter of the ink-sheet take-up roll 18 has changed, so that the procedures of steps S2 to S4 are executed again, detecting the N-value and writing it to the RAM 115.

If, on the other hand, it is determined in step S5 that the recording operation is to be started, the procedure advances to step S6 to execute the recording operation.

First, in step S11, one-line recording data is prepared; when a printing command is received, the procedure advances to step S12, where a motor driving trigger for driving the recording-paper feeding motor 24 so that the recording paper may be fed by a distance corresponding to one line, is transmitted. Then, the procedure advances to step S13, where a judgment is made as to whether the step number of the ink-sheet feeding motor 25 is 3 or not. In this case, the step number has already been set to 3 in step S2, so that the procedure advances to step S14, where a judgment is made as to whether or not the N-value is larger than 5. Again, although the feed distance of the recording paper 11 per unit time remains constant with respect to the drive-step number of the recording-paper feeding motor 24, the amount by which the ink sheet 14 is fed changes as the winding diameter of the take-up roller 18 varies; thus, even if the ink-sheet feeding motor 25 is driven in a steady manner, the amount by which the ink sheet 14 is fed per unit time will not remain constant. This means that the N-value will change, and it decreases as the recording proceeds. Thus, a judgment as to the N-value is made in step S14.

Assuming that adjacent slits 63 of the N-value sensor are spaced apart from each other by 10°, the slit signal of the N-value sensor 7 changes from ON to OFF, or from OFF to ON, each time the disc 61 is rotated 10°. In view of this, the requisite number of lines for rotating the disc 61 by 10° when the N-value is 5, which was previously obtained, is stored in the ROM 114. In step S14, the CPU 113 calls this number of lines and compares it with the average number of lines already written to the initial N-value storage area of the RAM 115 in step S4. When the average line number is greater than the requisite number of lines for rotating the disc 61 by 10° when the N-value is 5, it is determined that N is greater than 5. When it is determined, in step S14, that N is greater than 5, (which indicates the initial stages of use of the ink sheet), the procedure advances to step S15, where a driving trigger for the ink-sheet-feeding motor 25 is transmitted. Next, the procedure progresses to step S16, where the driving torque is decreased by reducing the driving energy for the ink-sheet feeding motor 25 to 80% of its maximum value. This reduction in power is effected since, as stated above, the diameter of the take-up roller 18 in the initial stages of use of the ink sheet is relatively small and, consequently, the requisite take-up torque is likewise small. By thus decreasing the driving torque exerted by the ink-sheet feeding motor 25, the rotating shaft of the motor 25 can be prevented from overrotating, and the ink sheet is protected from being subjected to an excessive load. Further, the amount of power wasted by the ink-sheet feeding motor 25 can be reduced.

This torque control for the ink-sheet feeding motor 25 can be effected by the recording control section 6 by reducing the current supplied to the motor driver 49 from, for example, 500 mA (100%) to 400 mA (80%). The number of drive steps of the ink-sheet feeding motor 25 is set to 3, contrasted with the drive-step number, 1, of the recording-paper feeding motor 24. The respective gear ratios between the motors and the feeding system are set such that here N is greater than 5.

Next, the procedure advances to step S19, where the thermal head 13 is driven to generate heat so as to effect recording of one-line information.

In step S20, the N-value is detected. Assuming that adjacent slits 63 of the N-value sensor 61 are spaced apart from each other by 10°, the requisite number of lines for rotating the disc 61 of the N-value sensor 62 by 10° is counted by the line counter, and the counting result is written to the line number storage area of the RAM 115 as an indicator of the N-value. The N-value is detected and written to the RAM 115 each time one line is recorded, thus updating the value written to the RAM.

When in step S21 the recording of one line has been completed, the procedure advances to step S22, where a judgment is made as to whether the recording of one page has been completed or not. In step S22, the CPU 113 detects the remaining amount of data in a record-image data buffer in the RAM 115 or the reception of a termination signal by the facsimile apparatus, and checks whether or not the recording of one page has been completed. When it is determined that the recording of one page has not yet been completed, the procedure returns to step S11, where the printing of the next line is effected, continuing recording until it is determined in step S22 that the recording of one page has been completed.

When it is determined in step S22 that the recording of one page has finished, the procedure advances to step S23, where the final value of the line number written to the line number storage area of the RAM 115 in step S20 is written as the final N-value to the initial N-value storage area of the RAM 115, thus updating the value.

Next, in step S8, the CPU 113 makes a judgment as to whether all the pages of a document have been recorded or not. When the recording of all the pages has not yet been completed, the procedure returns to step S5, where reception of the facsimile data of the next page is awaited. When it is determined in step S5 that the next-page facsimile data has been received, the recording operation in step S6 is started again.

Afterwards, in step S14, the final N-value, which was written to the initial N-value storage area of the RAM 115 in step S23 after the recording of the previous page, is called and a judgment is made as to whether or not N is greater than 5. Then, in the manner described above, the recording process proceeds until the recording of one page is completed. Thus, each time the recording of one page is completed, the final N-value is written to the initial N-value storage area of the RAM 115 in step S23, and the value is called in step S14 for the recording of the following pages and is used when determining whether or not N is greater than 5.

As the recording operation is thus continued line by line, the amount of the ink sheet 14 used increases, and so the diameter of the take-up roller 18 becomes larger. The amount by which the ink sheet 14 is fed by recording one line increases accordingly. When the condition N is less than or equal to 5 is attained in step S14, the procedure advances to step S17, where, as in step S15, a driving trigger for the ink-sheet feeding motor 25 is transmitted. Afterwards, the procedure advances to step S18, where the driving energy for the ink-sheet feeding motor 25 is increased to 100%, thereby increasing the driving torque.

This increase in the driving torque in effected because of the increase in the required take-up torque caused by the increase in the amount of the used portion of the ink sheet 14 and the corresponding increase in the diameter of the take-up roller 18. This torque control for the motor 25 can be effected by the recording control section 6 when it increases the amount of current supplied to the motor driver 49 from, for example, 400 mA to 500 mA.

It is determined in step S14 that N is less than or equal to 5 when the line number written to the RAM 115 in step S23 after the completion of the recording of the previous page is smaller than the requisite number of lines for rotating the disc 61 by 10° when N is 5.

In step S18, the drive step number of the ink-sheet feeding motor 25 is set to 2, i.e., one step less than the the previous step number (3), as contrasted with the step number 1 of the recording-paper feeding motor 24. This reduces the feed amount of the ink sheet 14 for recording one line, retaining a high N-value.

Next, the procedure progresses to step S19, where recording is performed in the same manner as described above.

Since the step number of the ink-sheet feeding motor 25 was set to 2 in step S18, the judgment result of step S13 when recording the next line is NO, i.e., the motor step number is not 3, and the procedure advances to step S17.

Thus, once the step number of the ink-sheet feeding motor 25 has been set to 2, the ink-sheet feeding motor 25 is driven with this step number being maintained unless the power is turned OFF and then turned ON or the ink cartridge is replaced by a new one.

Next, the recording operation of step S6 is terminated, and, when it is determined in step S8 that all the pages of the document have been recorded, the recording processing is at an end.

Thus, in accordance with this embodiment, the driving torque for feeding the ink-sheet is changed in accordance with the amount by which the ink sheet is fed per unit time with respect to a given drive amount of the ink-sheet feeding motor. By virtue of this arrangement, the ink-sheet is always taken up with an appropriate torque, thereby reducing the power consumed by the apparatus and suppressing noise.

While in the above-described embodiment the torque for the ink-feeding motor 25 was switched between only two levels, this should not construed restrictively; the torque can be switched between any number of values on the basis of the information from the N-value sensor 7. Further, it is also possible to store the information on the N-value obtained by the N-value sensor 7 and utilize it to change the torques of the motors when moving the ink sheet 14 for a purpose other than recording, for example, when taking up the ink sheet 14 to eliminate any slack thereof, or when feeding the ink sheet 14 or the recording paper 11 so as to replace the same by a new one, thereby helping to reduce noise.

Further, while in the above-described embodiment the change in the driving torque of the ink-sheet feeding motor was effected by changing the current value, this is not restrictive; it is also possible, for example, to change the torque by changing the driving voltage in accordance with the type of motor.

Further, in accordance with this invention, changes in the amount of the ink-sheet taken up by the ink-sheet feeding means can be detected in other ways; thus, apart from detecting variation in the amount of the ink sheet taken up by the ink-sheet feeding means from changes in the ink-sheet feed amount with respect to a given drive amount of the ink-sheet feeding means, it is also possible to detect changes in the diameter of the ink-sheet take-up roller 18 or of the ink-sheet supply roll 17 by means of a mechanical switch or a photo-interrupter, or to detect such changes on the basis of the cumulative number of pulses imparted to the ink-sheet feeding motor 25.

Further, while the above embodiment has been described as applied to a device using a multi-time ink sheet, which permits N recordings at the same position on the ink sheet, this invention is also applicable to a case where a so-called one-time ink sheet is used. In that case, the changes in the ink-sheet take-up amount can be obtained, as stated above, by directly detecting changes in the diameter of the ink-sheet take-up roller by means of a mechanical switch, etc.

While this embodiment has been described as used in the recording unit of a facsimile apparatus, this should not be construed restrictively. This invention is also applicable, for example, to an ordinary thermal transfer printer which is employed in a word processor, personal computer, typewriter, copying machine, etc.

As described above, in accordance with this invention, the driving torque of the ink-sheet feeding means is changed on the basis of the changes in the amount of the ink-sheet taken up by the ink-sheet feeding means, so that the ink sheet can always be taken up with an appropriate torque, thereby reducing noise, saving energy, and controlling the load on the ink sheet.

Figure 7:
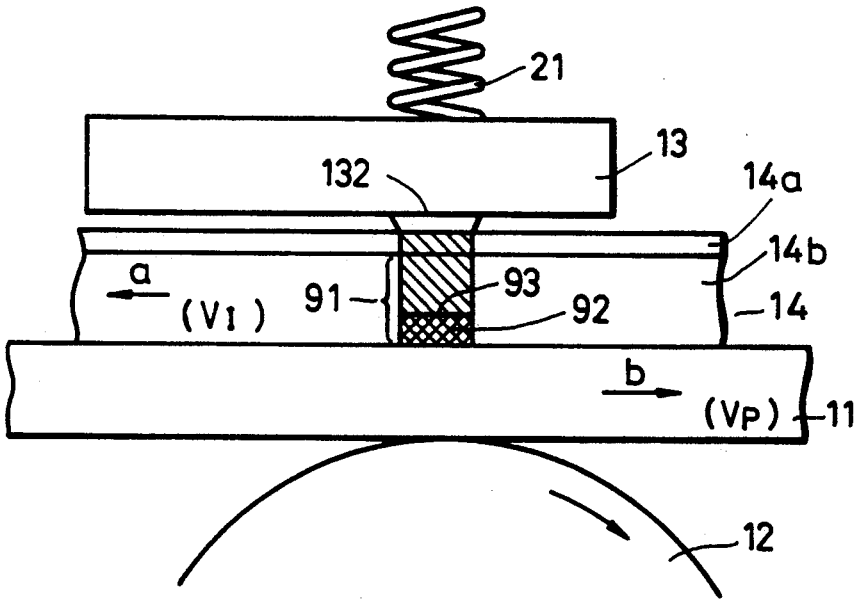
FIG. 7 is a diagram illustrating the way image recording is performed in accordance with this embodiment, with the recording paper and the ink sheet being fed in opposite directions.

Description of the Recording Principle (FIG. 7)

FIG. 7 is a diagram showing the way in which image recording is performed, with the recording paper 11 and the ink sheet 14 of this embodiment being conveyed in opposite directions.

As shown in the drawing, the recording paper 11 and the ink sheet 14 are held between the platen roller 12 and the thermal head 13, with the thermal head 13 being pressed against the platen roller 12 with a predetermined force by the spring 21. The recording paper 11 is fed in the direction of the arrow b at a speed of $V_P$ by the rotation of the platen roller 12. The ink sheet 14, on the other hand, is fed in the direction of the arrow a at a speed of $V_I$ by the rotation of the ink-sheet feeding motor 25.

When the heat generating device 132 of the thermal head 13 is energized by a power source 105 to generate heat, that portion of the ink sheet 14 which corresponds to a shadowed portion 91 is heated. Reference numeral 14*a* indicates the base film of the ink sheet 14, and reference numeral 14*b* indicates the ink layer disposed thereon. The ink-layer portion 91 heated by energizing the heat generating resistor 132 is melted, and a portion thereof, indicated at 92, is transferred onto the recording paper 11. The volume of this transferred ink-layer portion 92 corresponds to approximately 1/n (n is greater than 1) of that of the ink-layer portion 91.

In this transfer process, it is necessary to generate, at a border line 93, a shearing force with respect to the ink of the ink layer 14*b* so that only the ink portion 92 may be transferred to the recording paper 11. The requisite shearing force, however, varies depending upon the temperature of the ink layer: the higher the temperature of the ink layer, the smaller the requisite shearing force. Thus, by decreasing the time during which the ink sheet 14 is heated, the shearing force required to separate the ink layer becomes larger. If, however, the relative speed between the ink sheet 14 and the recording paper 11 is increased, the ink-layer portion to be transferred will be reliably separated from the ink sheet 14.

In this embodiment, the thermal head 13 in the facsimile apparatus is heated for a relatively short period of approximately 0.6 ms. To compensate for this, the ink sheet 14 and the recording paper 11 are fed in opposite directions, thereby increasing the relative speed therebetween.

Figure 8:
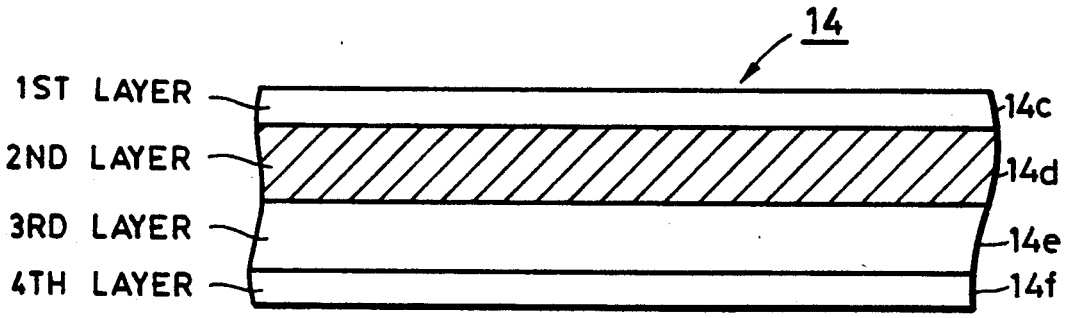
FIG. 8 is a sectional view of an ink sheet used to perform multi-print recording according to this embodiment.

Description of the Ink Sheet (FIG. 8)

FIG. 8 is a sectional view of an ink sheet used in a multi-printing device according to this embodiment. In this example, the sheet is composed of four layers.

The second layer 14*d* is a base film serving as the carrier for the ink sheet 14. In multi-printing, heat energy is repeatedly applied to the same position of the ink sheet; in view of this, it is beneficial to use as the base film an aromatic-polyamide film or capacitor paper, which offers a high level of heat resistance. However, conventional polyester films can also be used for the purpose. As to its thickness, to insure efficient heat transfer, it is desirable to make this layer as thin as possible since that would provide a better printing quality. From the viewpoint of strength, however, it is desirable that the layer thickness be in the range of 3 to 8 μm.

The third layer 14e is an ink layer containing ink in such a quantity as to enable an ink transfer onto recording paper (a recording sheet) to be effected N times (N is greater than 1). The main ingredients of this ink include a resin such as EVA serving as an adhesive, carbon black or a nigrosine dye for coloring, and carnauba wax or paraffin wax serving as a binder. The ink is composed so that it allows repeated use (N times) at a given position of the sheet. Though the preferable amount of ink applied to the base film ranges from 4 to 8 $g/m^2$, this is not restrictive, and the amount may be arbitrarily determined in accordance with the sensitivity and density desired.

The fourth layer 14f is a top coating layer which serves to prevent the ink of the third layer from being pressure-transferred to those sections of the recording paper where recording is not being performed. This top coating layer may consist, for example, of a transparent wax. Because of this arrangement, it is only the transparent fourth layer that can be pressure-transferred to the recording paper, thereby preventing the background of the recording paper from being stained.

The first layer 14c is a heat-resistant coating for protecting the second layer 14d, i.e., the base film, from the heat of the thermal head 13. The provision of this layer is helpful in multi-printing, where heat energy corresponding to a number of lines (n lines) is likely to be repeatedly applied to the same position of the sheet (i.e, where black information exist in succession). The provision of the first layer 14c is, however, optional. This heat-resistant coating layer 14c will prove effective when the base film 14d is one which offers a relatively low heat resistance, as is the case with a polyester film.

The construction of the ink sheet 14 is not restricted to that of this embodiment. For example, it is also possible for the ink sheet to be composed of a base layer and a porous ink-holder layer provided on one side of the base layer. Further, a heat-resistant ink layer having a porous network structure and containing ink may be provided on the base film. The material for the base film may be a paper or a film which consists, for example, of polyamide, polyethylene, polyester, polyvinyl chloride, triacetyl cellulose, or nylon. The material for the heat-resistant coating, which need not always be provided, may, for example, be a silicone resin, epoxy resin, fluororesin, nitro cellulose, etc.

One such example of an ink sheet containing a heat-sublimating ink is composed of a base material consisting, for example, of polyethylene terephthalate, polyethylene naphthalate, or an aromatic polyamide film; and a color material layer containing spacer particles formed of a guanamine resin and a fluororesin, and a dye.

Further, the heating method for the thermal transfer printer is not restricted to the above-described one, which uses a thermal head. For example, the energizing method or the laser transfer method may be used instead.

The recording medium is not restricted to paper; other materials, such as cloth or a plastic sheet will also serve the purpose as long as they allow the transfer of ink. Further, the ink sheet is not restricted to a roll-type one shown in the embodiment; it may also be of the so-called cassette type, with which an ink sheet is contained in a case which can be detachably attached to the recording apparatus body, the ink sheet being loaded and unloaded along with this case.

Further, in the above embodiment, the take-up amount of the ink sheet 14 corresponding to a given feed amount of the recording medium for the recording of the next page was determined when the loading of an ink sheet has been detected, with the recording being performed by the thermal head 13. This also applies to a case where the loading of a ink-sheet cartridge is detected. Further, while in the above embodiment, the ink-sheet feeding motor 25 is driven in two or three half-steps, the number of driving steps for this ink-sheet feeding motor 25 can be switched between a larger number of driving steps.

Further, while the above embodiment has been described as applied to a recording apparatus using a thermal line head, this should not be construed restrictively; it can also be applied to a thermal transfer printer of the so-called serial type.

Figure 9:
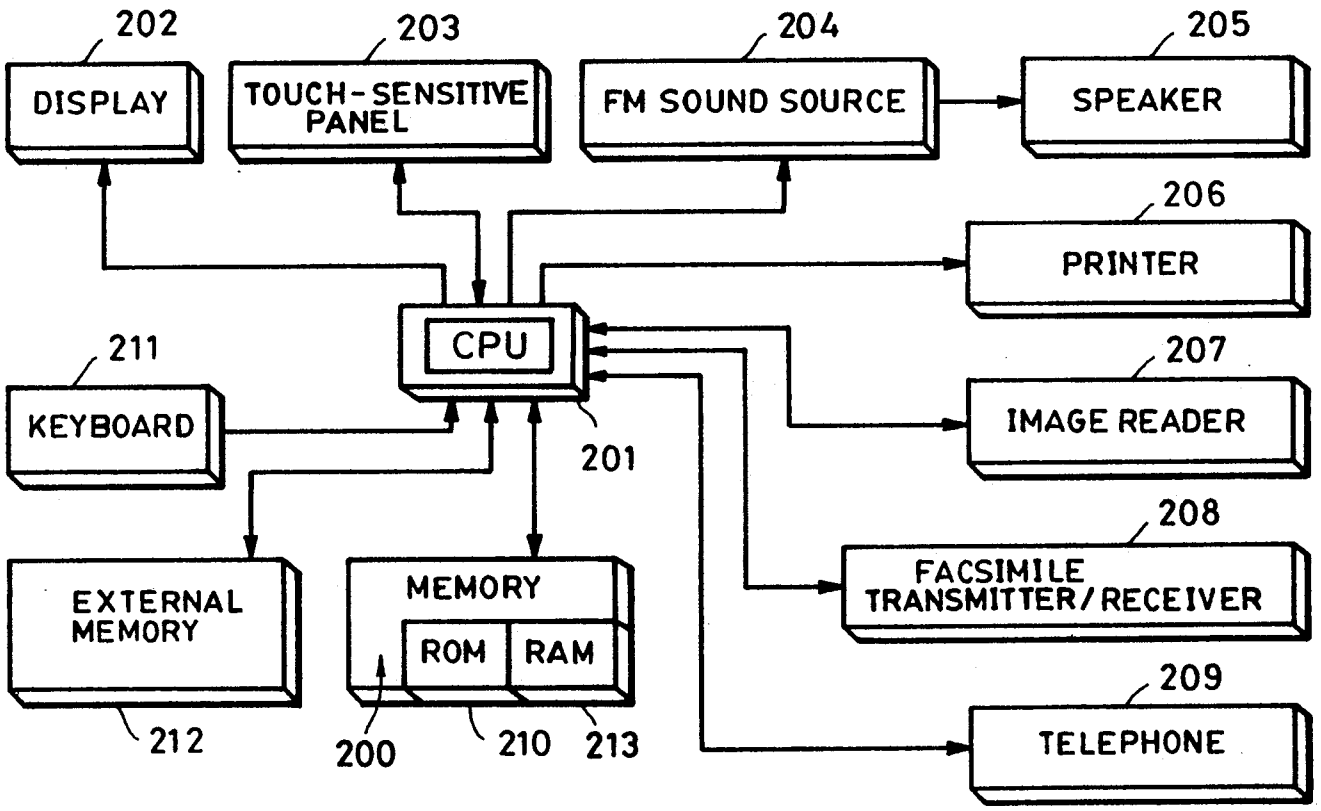
FIG. 9 is a block diagram schematically showing the construction of the thermal transfer recording apparatus of this invention when applied to an information processing apparatus.

FIG. 9 is a block diagram showing the thermal transfer recording apparatus of this invention as used in an information processing apparatus such as a personal computer, facsimile apparatus, copying machine, electronic typewriter, etc. Reference numeral 201 indicates a control section for controlling the entire apparatus, and it is equipped with a CPU consisting of a microprocessor (not shown), etc. and various type of I/O ports (not shown), and is adapted to perform control by transmitting and receiving control signals, data signals, etc. to and from different parts of the apparatus. Reference numeral 202 indicates a display section which shows various menus, document information, image data read by an image reader 207, etc. Reference numeral 203 indicates a pressure-sensitive touch panel provided on the display section 202; by depressing the surface of this panel with a finger or the like, item input, coordinate-position input, etc. can be performed on the display section 202.

Reference numeral 204 indicates an FM (frequency modulation) sound source, which stores music information prepared by a music editor, etc. in a memory section 210 or an external memory 212 in the form of digital data, and reads it out from the memory, etc. so as to perform frequency modulation on it. Electrical signals from the FM sound source 204 are converted to audible sounds by means of a speaker section 205.

A printer section 206 consists of a thermal transfer recording apparatus constructed in accordance with this invention. It constitutes the output terminal of a word processor, personal computer, facsimile apparatus, copying machine, electronic typewriter, etc.

The image reader section 207, mentioned above, reads original data photoelectrically; it is provided in the original feeding path and is capable of reading various types of originals, such as facsimile originals or originals to be copied. Reference numeral 208 indicates a facsimile transmitter/receiver section, which transmits original data read by the image reader section 207 and which receives any facsimile signal transmitted thereto and decodes it; the section 208 functions as an interface between this information processing apparatus and outside systems. Reference numeral 209 indicates a telephone section, which provides, apart from the function of an ordinary telephone, various other telephone functions including that of an answering machine. The memory section 200, mentioned above, includes a ROM 210 for storing various application programs, such as a system program or a manager program, character fonts, dictionaries, etc.; this memory section further includes a RAM 213 for storing application programs, character information, etc. loaded into it from an external memory 212, and a video RAM. Reference numeral 305 indicates a slot through which a floppy disk can be inserted.

Reference numeral 211 indicates a keyboard section for entering character information, various commands, etc. The external memory 212, mentioned above, may use floppy disks or a hard disk, etc. as the storage medium. This external memory stores character information, music or voice information, user application programs, etc.

Figure 10:
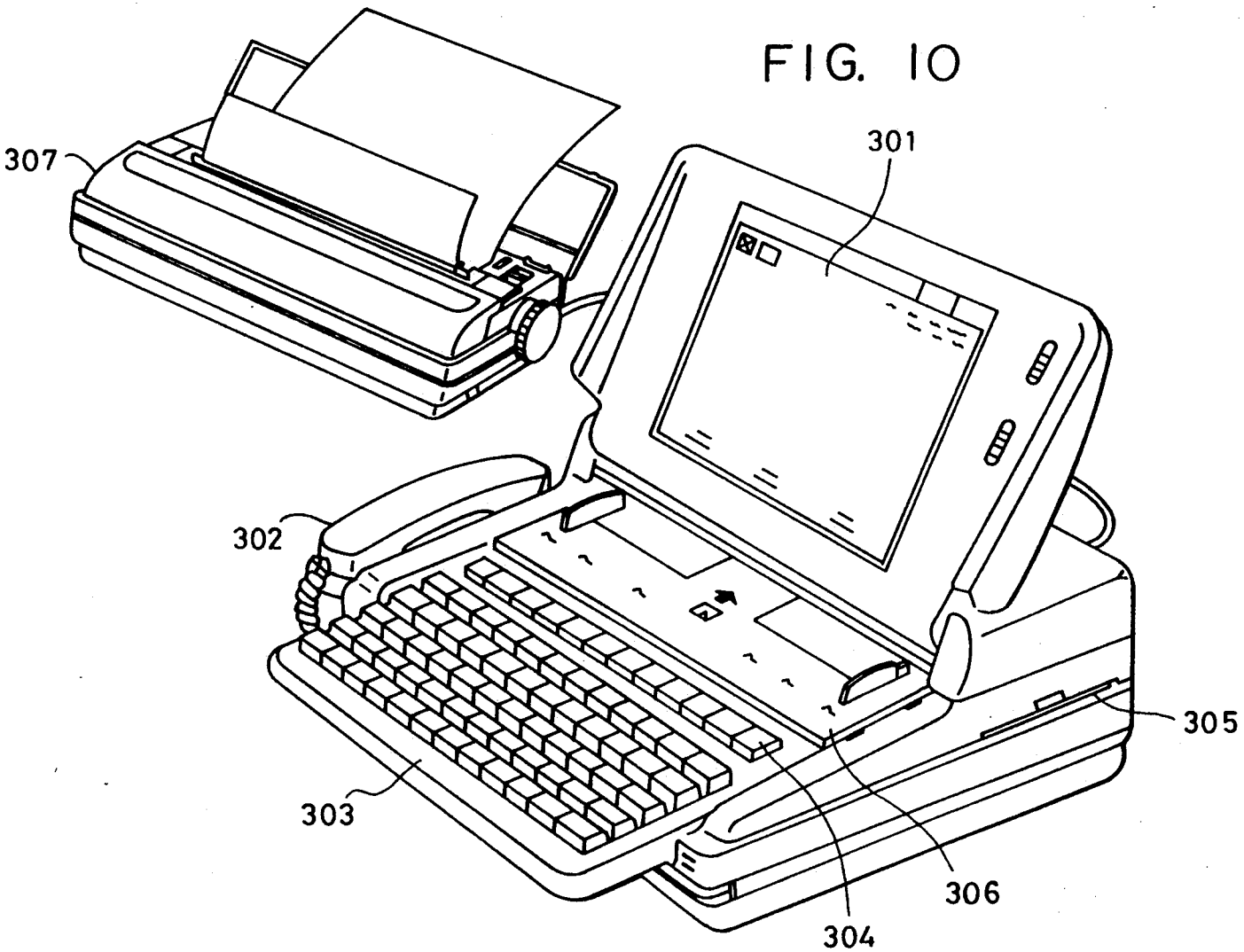
FIG. 10 is an external view of the information processing apparatus of FIG. 9.

FIG. 10 is an external view of the information processing apparatus shown in FIG. 9. In the drawing, reference numeral 301 indicates a flat panel display for displaying various menus, figure information, document information, etc. Provided on the display 301 is a touch-sensitive panel; by depressing this touch-sensitive panel with a finger or the like, coordination input, item designation input, etc. can be entered. Reference numeral 302 indicates a handset which is used when the apparatus functions as a telephone.

A keyboard 303 is connected to the apparatus body through a cord and can be used to enter various types of character information, data, etc. The keyboard 303 is equipped with various function keys 304, etc.

Reference numeral 307 indicates a device on which originals to be read by the image reader section 207 are set; after they have been read, the originals are discharged from the rear section of the device 307. In the case of facsimile communication, etc., the received information is recorded by a printer 306.

While the above display 301 may consist of a CRT, a flat panel, such as a liquid crystal display using ferroelectric liquid crystals, is more preferable since that helps to reduce the weight, as well as the size and thickness, of the apparatus.

When this information processing apparatus functions as a personal computer or a word processor, various items of information, entered at the keyboard 211, are processed in accordance with predetermined programs by the control section 201 and are supplied to the printer section 206 in the form of images.

When the apparatus functions as the receiver of a facsimile apparatus, facsimile information, entered at the facsimile transmitter/receiver section 208 through a communication line, are processed in accordance with a predetermined program by the control section 201 and are supplied to the printer section 206 as reception images.

Figure 11:
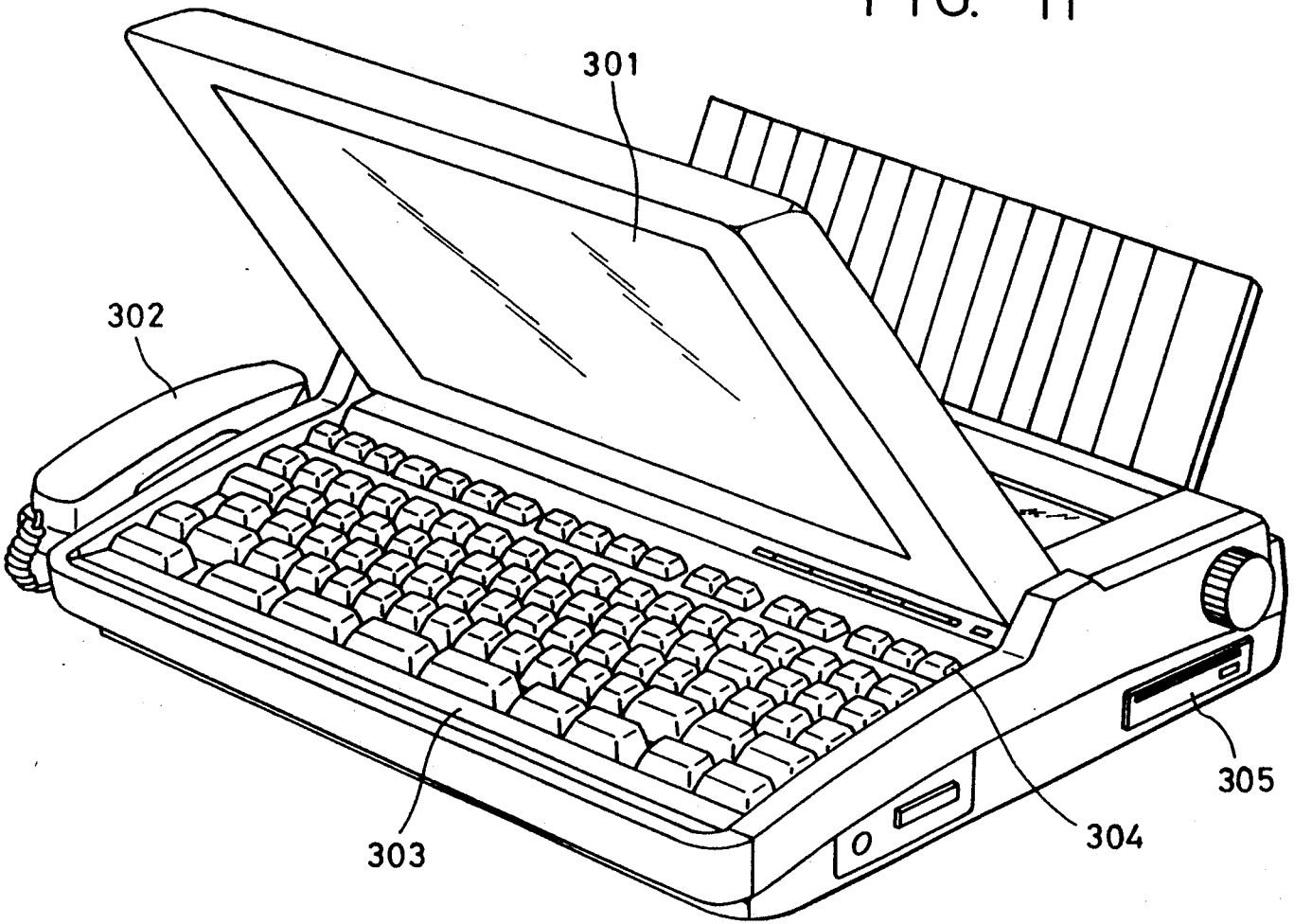
FIG. 11 is an external view showing another example of an information processing apparatus to which this invention is applicable.

When this information processing apparatus functions as a copying machine, the original is read by the image reader section 207, the original data read being supplied to the printer section 206 through the control section 201. Further, when the information processing apparatus functions as the transmitter of a facsimile apparatus, the original data read by the image reader section 207 is processed for transmission by the control section 201 in accordance with a predetermined program; afterwards, it is transmitted through the facsimile transmitter/receiver section 208 to the communication line. This information processing apparatus may also be of an integral type in which, as shown in FIG. 11, the apparatus body incorporates an internal printer; in that case, the apparatus is further improved because it is more portable. In FIG. 11, the same reference numerals are given to the components having the same functions as those of FIG. 10.

Thus, when applied to a multi-function-type information processing apparatus as described above, the thermal transfer recording apparatus of this invention helps to obtain high-quality record images, whereby the functions of the information processing apparatus can be further improved.

What is claimed is:

1. A thermal transfer recording apparatus which performs image recording by transferring an ink of an ink sheet onto a recording medium, said recording apparatus comprising:

ink sheet feeding means for feeding said ink sheet by taking up said ink sheet, said ink sheet feeding means comprising an ink sheet feeding motor having a driving torque;

recording medium feeding means for feeding said recording medium;

recording means for acting on said ink sheet so as to effect recording on said recording medium, recording of one line being performed once all recording data corresponding to that line have been received;

detection means for detecting information corresponding to an amount of said ink sheet which is taken up by said ink sheet feeding means; and noise reducing means for setting the drive torque of said ink sheet feeding motor of said ink sheet feeding means at a low level when it is determined based on said detected information that the amount of said ink sheet which is taken up is less than a predetermined amount and driving said ink sheet feeding motor accordingly, and setting the driving torque at a level higher than said low level when it is determined based on said detected information that the amount of said ink sheet which is taken up is at least a predetermined amount and driving said ink sheet feeding motor accordingly.

2. A thermal transfer recording apparatus according to claim 1, said ink-sheet feeding means further comprising a rotatably mounted take-up roller subject to the driving torque and a supply roller, said ink sheet being stretched between said take-up roller and said supply roller so that said ink sheet may be fed when said take-up roller is rotated.

3. A thermal transfer recording apparatus according to claim 2, wherein said noise reducing means changes a drive amount of said take-up roller in accordance with the detection result obtained by said detection means.

4. A thermal transfer recording apparatus according to claim 3, wherein said noise reducing means controls such that when said detection means detects that the take-up amount of said ink sheet is in excess of the given amount, the drive amount of said take-up roller is reduced from a previously-used value.

5. A thermal transfer recording apparatus according to claim 1, wherein said detection means detects changes in the take-up amount of said ink sheet by detecting changes in a distance by which said ink sheet is fed with respect to a given drive amount of said ink-sheet feeding means.

6. A thermal transfer recording apparatus according to claim 1, wherein said noise reducing means controls such that an amount of said ink sheet that is fed by said ink-sheet feeding means per unit time is smaller than an amount of said recording medium fed by said recording medium feeding means per unit time.

7. A facsimile apparatus which performs image recording by transferring an ink of an ink sheet onto a recording medium, said facsimile apparatus comprising:

ink sheet feeding means for feeding said ink sheet by taking up said ink sheet, said ink sheet feeding means having an ink sheet feeding motor having a driving torque;

recording medium feeding means for feeding said recording medium;

image signal receiving means for receiving an image signal;

recording means for acting on said ink sheet in accordance with the image signal received by said image signal receiving means so as to effect recording on said recording medium, recording of one line being performed once all recording data corresponding to that line have been received;

detection means for detecting information corresponding to an amount of said ink sheet taken up by said ink sheet feeding means; and noise reducing means for setting the driving torque of said ink sheet feeding motor of said ink sheet feeding means at a low level when it is determined based on said detected information that the amount of said ink sheet which is taken up is less than a predetermined amount and driving said ink sheet feeding motor accordingly, and setting the driving torque at a level higher than said low level when it is determined based on said detected information that the amount of said ink sheet which is taken up is at least a predetermined amount and driving said ink sheet feeding motor accordingly.

8. A thermal transfer recording apparatus which performs image recording by transferring an ink of an ink sheet onto a recording medium, said recording apparatus comprising:

ink sheet feeding means for feeding said ink sheet by taking up said ink sheet, said ink sheet having an ink sheet feeding motor having a driving torque;

recording medium feeding means for feeding said recording medium;

recording means for acting on said ink sheet so as to effect recording on said recording medium, recording of one line being performed as soon as all recording data corresponding to that line have been received;

detection means for detecting an amount by which said ink sheet is fed with respect to a given drive amount of said ink sheet feeding means; and noise reducing means for controlling which drives said ink sheet feeding means and said recording medium feeding means such that said ink sheet is fed by an amount which is smaller than the amount by which said recording medium is fed, and which sets the driving torque of said ink sheet feeding motor of said ink sheet feeding means at a low level when it is determined based on said detected information that the amount of said ink sheet which is taken up is less than a predetermined amount and drives said ink sheet feeding motor accordingly and sets the driving torque of said ink sheet feeding motor at a level higher than said low level when it is determined based on said detected information that the amount of said ink sheet which is taken up is at least a predetermined amount and drives said ink sheet feeding motor accordingly.

9. A method of reducing noise associated with operation of a thermal transfer recording apparatus having ink sheet feeding means for feeding an ink sheet by taking up said ink sheet and which performs image recording by transferring an ink from said ink sheet onto a recording medium, comprising the steps of:

receiving recording data and then preparing one-line recording data;

detecting information corresponding to an amount of said ink sheet which is taken up by said ink sheet feeding means;

setting the driving torque of an ink sheet feeding motor of said ink sheet feeding means at a low level when it is determined based on said detected information that the amount of said ink sheet which is taken up is less than a predetermined amount and driving said ink sheet feeding motor accordingly;

setting the driving torque of said ink sheet feeding motor at a level higher than said low level when it is determined based on said detected information that the amount of said ink sheet which is taken up is at least a predetermined amount and driving said ink sheet feeding motor accordingly; and performing one-line recording in accordance with said prepared recording data once all said prepared recording data corresponding to one line have been received.

* * * * *